United States Patent [19]

Nakazawa et al.

[11] 4,278,581

[45] Jul. 14, 1981

[54] MOLD BINDER MATERIAL

[75] Inventors: Tetsuo Nakazawa, Shimoinayoshi; Junji Sakai, Minorimachi; Syogo Morimoto, Matsudo; Takatoshi Tanigawa, Tokyo; Ryoji Takahashi, Yukuhashi; Seiji Okazaki, Kitakyushu, all of Japan

[73] Assignees: Hitachi, Ltd.; Hitachi Metals, Ltd., both of Tokyo, Japan

[21] Appl. No.: 946,020

[22] Filed: Sep. 26, 1978

[30] Foreign Application Priority Data

| | | | |
|---|---|---|---|
| Sep. 28, 1977 | [JP] | Japan | 52-115588 |
| Sep. 28, 1977 | [JP] | Japan | 52-115589 |
| Sep. 28, 1977 | [JP] | Japan | 52-115592 |
| Sep. 28, 1977 | [JP] | Japan | 52-115594 |

[51] Int. Cl.[3] ..... C08L 23/08

[52] U.S. Cl. ..... 260/29.6 M; 260/29.6 H; 260/42.51; 260/42.52

[58] Field of Search ..... 260/42.51, 42.52, 42.49, 260/998.18, DIG. 40, 42.43, 29.6 M, 29.6 H

[56] References Cited

U.S. PATENT DOCUMENTS

| | | | |
|---|---|---|---|
| 2,765,507 | 10/1956 | Wolf et al. | 260/998.18 |
| 3,645,937 | 2/1972 | Lang et al. | 260/42.51 |
| 3,960,798 | 6/1976 | Nakazawa et al. | 260/42.51 |

FOREIGN PATENT DOCUMENTS

| | | | |
|---|---|---|---|
| 432964 | 11/1974 | U.S.S.R. | 260/42.51 |

OTHER PUBLICATIONS

Condensed Chemical Dictionary; 7th Ed.; 1966; p. 864.

*Primary Examiner*—Lewis T. Jacobs
*Attorney, Agent, or Firm*—Craig and Antonelli

[57] ABSTRACT

In a mold to be hardened by a $CO_2$ gas, a mold binder material comprising a combination of polymers containing carboxyl groups, at least one of multi-valent metal oxides and multi-valent metal hydroxides, and resins of polyvinyl alcohol group, and at least one of sodium salt of gluconic acid and polyhydric alcohols or a mold binder material comprising a combination of polymers having carboxyl groups, at least one of multi-valent metal oxides and multi-valent metal hydroxides, and at least one of sodium salt of gluconic acid and polyhydric alcohols is provided. By use of the present binder material, the following various effects can be obtained: (1) easy preparation of mold sand, (2) easy removal of the binder material by water washing even if bodies or clothes are fouled by the binder material, (3) a longer working time of mold sands, (4) a higher mold strength, (5) an improved working atmosphere at shaping of the mold, (6) an improved production efficiency of molds, (7) the desired mold strength being obtained with a smaller amount of $CO_2$ gas used, etc.

9 Claims, No Drawings

MOLD BINDER MATERIAL

BACKGROUND OF THE INVENTION

This invention relates to mold binder materials.

Molds for casting metal so far in practical use employ an inorganic binder such as sodium silicate, or employ phenol resin, furan resin and other organic binders. Any of these molds has a property to withstand the pressure or heat at the casting of molten metal, but the former has a poor collapsing ability of mold after the casting, and thus an operation to take out the casting is so difficult that number of steps of producing a casting is increased. The mold using an organic binder has no such problem.

As a process for hardening a mold, there are available a self hardening process by chemical reaction of binder components added to mold sands and a cold set process for hardening a mold by injecting a $CO_2$ gas or an amine gas into a mold, after mold sands containing a binder are filled around a pattern. In the former process for hardening a mold, a chemical reaction starts at the same time when the binder is added to the mold sands, and thus, a time for effective utilization of mold sands, that is, the so-called working time, is restricted. The latter process includes the so-called $CO_2$ process for hardening by injecting a $CO_2$ gas into mold sands containing sodium silicate as a binder, a process for hardening by injecting an amine gas into mold sands containing a hydroxyl group-containing resin (for example, phenol resin) and a polyisocyanate as binders, and a process for hardening mold sands containing a combination of copolymer of acrylic acid ester and ammonium acrylate and sodium acrylate or phenolic resin, and calcium hydroxide by a $CO_2$ gas. A longer working time of these mold sands can be assured than said chemical reaction of the binder components in the mold sands, and the mold can be immediately hardened by the injection of the gas, and thus the production efficiency of molds is better. However, since the $CO_2$ process uses sodium silicate as a binder, the collapsing property of molds is poor, and the process using the amine gas has a problem in toxicity and smell of the amine gas. The process based on the combination of copolymers of acrylic acid ester and ammonium acrylate and sodium acrylate, and calcium hydroxide and a $CO_2$ gas has the following problems: (1) an ammonia gas is evolved at the preparation of mold sands or shaping of molds, deteriorating the working atmosphere, and (2) a sufficient strength cannot be obtained right after the injection of $CO_2$ gas.

Furthermore, the process using the phenol resin does not pollute the working atmosphere due to generation of ammonia gas, etc., but the hardening of the mold after the injection of the gas is conducted only by drying, and the strength of the mold is less increased.

The present inventors previously proposed a process for preparing a mold, based on a combination of polyvinyl alcohol and calcium hydroxide or calcium oxide, and a $CO_2$ gas as art to improve the problems of $CO_2$ process and other molds as said prior art, and the proposed process can advantageously improve the prior art considerably, but has a difficulty in uniform hardening to the inside of the mold, when a large mold is prepared.

SUMMARY OF THE INVENTION

An object of the present invention is to provide a mold binder material which can improve said problems, utilizing said advantages of the prior art, and more specifically is to provide a mold binder material having the following effects: (1) easy preparation of mold sand, (2) easy removal of the binder material by water washing even if bodies or clothes are fouled by the binder material, (3) a longer working time of mold sands, (4) a higher mold strength, (5) an improved working atmosphere at shaping of the mold, (6) an improved production efficiency of molds, and (7) the desired mold strength being obtained with a smaller amount of $CO_2$ gas used.

In a mold to be hardened by a $CO_2$ gas, the present invention provides a mold binder material comprising a combination of polymers containing carboxyl groups, at least one of multi-valent metal oxides and resins of polyvinyl alcohol group and multi-valent metal hydroxides, and at least one of sodium salt of gluconic acid and polyhydric alcohols, or a mold binder material comprising a combination of polymers containing carboxyl groups, at least one of multi-valent metal oxides and multi-valent metal hydroxides, and at least one sodium salt of gluconic acid and polyhydric alcohols.

The present mold binder material has the advantages of the $CO_2$ process and the advantages of the mold using the organic binder at the same time. Components constituting the present mold binder material will be described in detail below:

The polymers containing carboxyl groups include:

(1) homopolymers consisting of monomers having one or more carboxyl groups in one molecule, such as acrylic acid, methacrylic acid, crotonic acid, itaconic acid and their monoesters, fumaric acid and its monoesters, maleic acid and its monoesters, citraconic acid and its monoesters, mesaconic acid and its monoesters, etc., and binary or multi-component copolymers consisting of these monomers and such unsaturated monomers copolymerizable with the former monomers as styrene, styrene derivatives, alkenes, cyclohexene, vinyl halides, vinyl and allyl esters of saturated carboxylic acids, acrylamide, vinyl and allyl alkyl ethers, acrylic acid esters, methacrylic acid esters, crotonic acid esters, maleic acid diesters, and fumaric acid diesters;

(2) hydrolysis or alkali saponification products of homopolymers consisting of monomers containing functional groups convertible to carboxyl groups by hydrolysis or alkali saponification, such as maleic anhydride, citraconic anhydride, itaconic anhydride, acrylamide, acrylic acid esters, methacrylic acid esters, crotonic acid esters, maleic acid diesters, fumaric acid diesters, etc., and binary or multi-component copolymers consisting of these monomers and unsaturated monomers copolymerizable with the former monomers;

(3) polymers having carboxyl groups prepared by introducing carboxyl groups to polymers having reactive functional groups at their side chains through reaction such as etherification, esterification, acetalization, etc., for example, oxalic acid-esterified polyvinyl alcohol, glycolic acid-etherified polyvinyl alcohol, glyoxalic acid-acetalized polyvinyl alcohol, etc.

Particularly preferable polymers containing carboxyl groups among them are styrene-maleic anhydride copolymer, methylvinyl ether-maleic anhydride copolymer, and $\alpha$-olefin-maleic anhydride copolymer. Among the polymers containing the carboxyl groups, only water can be used as a solvent for those readily soluble in water, and water containing a caustic alkali is used as a solvent for those not readily soluble or insoluble in water.

Multi-valent metal oxides or hydroxides used in the present invention include oxides or hydroxides of calcium, magnesium, barium, zinc, aluminum, iron, etc. and further include those containing these oxides or hydroxides as their constituents, such as bentonite, clay, talc, or "Satin White", a complex of aluminum sulfate and calcium hydroxide. Among these oxides or hydroxides, those of calcium, magnesium, and barium are particularly preferable. Among these metal oxides or hydroxides, only one species can be used as to the calcium group. For others, simultaneous use of two or more species including one species of the calcium group is more effective.

It is preferable to use not more than 800% by weight, preferably not more than 300% by weight, of these metal oxides or hydroxides on the basis of the polymer containing carboxyl groups. The metal oxides or hydroxides can be used as the component for the mold binder material by suspending them in an aqueous solution of the polymer in advance, or adding them alone to mold sands.

The resins of polyvinyl alcohol group used in the present invention include partially saponified polyvinyl alcohol, completely saponified polyvinyl alcohol, polyvinyl alcohol containing acrylamide groups, polyvinyl alcohol containing acylic acid groups, etc. It is preferable to add 5 to 100% by weight, particularly preferably 5 to 30% by weight of the resins of polyvinyl alcohol group on the basis of the polymer containing carboxyl groups. If the amount added is less than 5% by weight, an adherence is lowered, and if it exceeds 100%, a viscosity is so increased as to disturb a workability.

Sodium salt of gluconic acid used in the present invention is represented by such a molecular formula as $C_6H_{11}O_7Na$. It is preferable to add not more than 100% by weight, particularly preferably 3 to 50% by weight of sodium salt of gluconic acid, on the basis of the aqueous solution of polymers having carboxyl groups.

The polyhydric alcohol is effective upon an increase in the strength at the initial period of molding, and can be added to a binder composition in advance, or can be added alone to mold sands. It is preferable to add not more than 100% by weight, particularly preferably 3 to 40% by weight of the polyhydric alcohol on the basis of the aqueous solution of polymers having carboxyl groups. The polyhydric alcohol used in the present invention includes ethylene glycol, glycerine, propylene glycol, sorbitol, mannite, and other polyhydric alcohols and other derivatives.

The preferable polymers used in the present invention are styrene-maleic anhydride copolymers, methylvinyl ether-maleic anhydride copolymers, and α-olefin-maleic anhydride copolymers, as described above. These polymers require a caustic alkali, water glass, etc., when dissolving these polymers in water, whereby alkali metals such as Na, K, etc. can be bonded to the carboxyl groups of these polymers to make them dissolve in water. The styrene-maleic anhydride copolymers, methylvinyl ether-maleic anhydride copolymers and α-olefin-maleic anhydride copolymers used in the present invention, can include terpolymers; for example, in the case of the α-olefin-maleic anhydride copolymers, they can include not only copolymers of α-olefin and maleic anhydride, but also terpolymers of, for example, α-olefin, maleic anhydride, and maleic acid diester. Furthermore, the copolymer of α-olefin and maleic acid monoester can include not only the copolymers of α-olefin and maleic acid monoester, but also copolymers of these two components as essential and a further component, for example, a terpolymer of α-olefin, maleic acid monoester, and maleic acid diester, etc. α-Olefins used in the present invention are straight or branched olefin having 2 to 8, preferably 2 to 6 carbon atoms, for example, ethylene, propylene, n-butene, isobutylene, n-pentene, isoprene, 2-methyl-1-butene, etc.

The mold binder material can be admixed with wood powders, or various emulsion, latex, etc. to increase the binding force, and water resistance or adjust the viscosity according to the amounts added.

The present binder material thus prepared can be packaged in the following four types, (A), (B), (C) and (D).

(A) First pack: aqueous solution of polymers containing carboxyl groups, second pack: metal oxide or hydroxide, third pack: aqueous solution of resin of polyvinyl alcohol group, and fourth pack: sodium salt of gluconic acid.

(B) First pack: mixture of metal oxide or hydroxide suspended in aqueous solution of polymers having carboxyl groups and further admixed with sodium salt of gluconic acid, and second pack: aqueous solution containing resin of polyvinyl alcohol group.

(C) First pack: mixture of aqueous solution of polymers having carboxyl groups, metal oxide or hydroxide, and aqueous solution of resin of polyvinyl alcohol group and second pack: sodium salt of gluconic acid.

(D) Single pack: mixture of aqueous solution of polymers having carboxyl groups, metal oxide or hydroxide, aqueous solution of resin of polyvinyl alcohol group, and sodium salt of gluconic acid.

Mold sands can be obtained from the binder materials thus packaged, by adding and mixing four packs to casting sands in the case of type (A), two packs in the cases of types (B) and (C), and only one pack in the case of type (D).

Furthermore, the present binder material can be packaged in other four types (E), (F), (G) and (H).

(E) First pack: aqueous solution of polymers having carboxyl groups, second pack: metal oxide or hydroxide, third pack: aqueous solution of resin of polyvinyl alcohol group, and fourth pack: polyhydric alcohol.

(F) First pack: mixture of metal oxide or hydroxide suspended in aqueous solution of polymers containing carboxyl groups, and further admixed with polyhydric alcohol, and second pack: aqueous solution of resin of polyvinyl alcohol group.

(G) First pack: mixture of aqueous solution of polymers having carboxyl groups, metal oxide or hydroxide, and aqueous solution of resin of polyvinyl alcohol group, and second pack: polyhydric alcohol.

(H) Single pack: mixture of aqueous solution of polymers having carboxyl groups, metal oxide or hydroxide, aqueous solution of resin of polyvinyl alcohol group, and polyhydric alcohol.

Mold sands can be obtained from the binder materials thus packaged by adding and mixing four packs to casting sands in the case of type (E), two packs in the case of types (F) and (G), and only one pack in the case of type (H).

Furthermore, the present binder material can be packaged in further three types (I), (J), and (K).

(I) First pack: alkali-neutralized aqueous solution of polymers having carboxyl groups, second pack: metal oxide or hydroxide, and third pack: sodium salt of gluconic acid.

(J) First pack: suspension of metal oxide or hydroxide in alkali-neutralized aqueous solution of polymers having carboxyl groups, and second pack: sodium salt of gluconic acid.

(K) Single pack: mixture of metal oxide or hydroxide suspended in alkali-neutralized aqueous solution of polymers having carboxyl groups, and further admixed with sodium salt of gluconic acid.

Mold sands can be prepared from the binder materials thus packaged by adding and mixing three packs to casting sands in the case of type (I), and two packs in the case of type (J), and only one pack in the case of type (K).

Furthermore, the present binder material can be packaged in further three types (L), (M) and (N).

(L) First pack: alkali-neutralized aqueous solution of polymers having carboxyl groups, second pack: metal oxide or hydroxide, and third pack: polyhydric alcohol.

(M) First pack: suspension of metal oxide or hydroxide in alkali-neutralized aqueous solution of polymers having carboxyl groups, and second pack: polyhydric alcohol.

(N) Single pack: mixture of metal oxide or hydroxide suspended in alkali-neutralized aqueous solution of polymers having carboxyl groups and further admixed with polyhydric alcohol.

The mold sands thus obtained are filled around a pattern, and a $CO_2$ gas is injected into the filled mold sands, whereby a mold is immediately hardened. The resulting mold can be utilized for casting.

When the mold sands are hermetically sealed without any injection of the $CO_2$ gas, the mold sands are not hardened, and can be reserved for a long period of time.

As already described above, the following effects can be obtained by the present mold binder material: (1) easy preparation of mold sands, (2) easy removal of the binder material by water washing, even if bodies and clothes are fouled by the present binder material, (3) a long working time of mold sands, (4) a high mold strength, (5) an improved working atmosphere at the shaping of mold, (6) a higher production efficiency of the mold, (7) the desired mold strength being obtained even with a smaller amount of a $CO_2$ gas, and (8) the mold being self-hardening after the injection of a $CO_2$ gas.

The present invention will be described in detail below, referring to Examples, but will not be restricted thereby.

EXAMPLE 1

25 g of copolymers of $\alpha$-olefin (isobutylene) and maleic anhydride, 13 g of caustic soda, and 60 g of water were mixed together and made into solution by heating at 65° C. The resulting solution was admixed with 30 g of slaked lime, and successively with 60 g of water, and a white suspension solution was prepared by stirring the mixture. The solution was admixed with 10 g of an aqueous solution of partially saponified polyvinyl alcohol at a concentration of 25% by weight and 10 g of sodium salt of gluconic acid to prepare a binder composition.

40 g of the resulting binder composition was admixed with 1 kg of silica sands, JIS No. 100*, and the resulting mixture was formed into test pieces, 50 mm in diameter×50 mm long, by ramming. The test pieces were aerated with a $CO_2$ gas under a pressure of 1 kg/cm$^2$ for 5 seconds, and changes in strength with time from the preparation of test pieces were investigated. As a comparative example, test pieces were prepared by mixing 1 kg of the same silica sand as above with 30 g of a binder of copolymers of acrylic acid ester and ammonium acrylate, 20 g of water and 20 g of slaked lime, and subjected to the same test as above. The results are shown in Table 1.

TABLE 1

| | Compression strength (kg/cm$^2$) | | | | | |
|---|---|---|---|---|---|---|
| Time (hr.) | Right after molding | 1 | 2 | 3 | 4 | 24 |
| Test piece 1 (the present invention) | 7.3 | 10 | 13 | 15 | 18 | 37 |
| Test piece 2 (comparative example) | 1.5 | 2.6 | 3.5 | 4.6 | 4.8 | 16 |

Strength right after the molding and increase in the strength with time, and the strength after 24 hours are high in the present invention, and also the working atmosphere is good, whereas in the comparative example, an ammonia smell is generated at the preparation of mold sands or molding, and thus the working atmosphere is a problem, and also the mold strength is relatively low.

*JIS No. 100 indicates particle sizes of silica sand set forth by Japanese Industrial Standard, and shows that there is a peak in the particle sizes at 100-mesh.

EXAMPLE 2

25 g of copolymers of styrene-maleic anhydride, 8 g of caustic soda, and 70 g of water were mixed together and made into solution by heating at 65° C. The resulting solution was admixed with 30 g of slaked lime, and successively with 60 g of water to make a white suspension solution. The resulting solution was admixed with 10 g of an aqueous solution of completely saponified polyvinyl alcohol at a concentration of 25% by weight and 15 g of sodium salt of gluconic acid to obtain a binder composition. As a result of tests in the same composition and manner as in Example 1, it was found that a compression strength was 7.0 kg/cm$^2$ right after the molding and 32 kg/cm$^2$ after 24 hours.

EXAMPLE 3

25 g of copolymers of styrene-maleic anhydride, 8 g of caustic soda, and 70 g of water were mixed together, and made into solution by heating at 65° C. The resulting solution was admixed successively with 20 g of aluminum hydroxide, 20 g of slaked lime, and 60 g of water, and then stirred to make a suspension solution. The resulting solution was admixed with 10 g of an aqueous solution of partially saponified polyvinyl alcohol at a concentration of 25% by weight and 40 g of sodium salt of gluconic acid to obtain a binder composition. As a result of tests in the same manner as in Example 1, it was found that a compression strength was 9.6 kg/cm$^2$ right after the molding and 36 kg/cm$^2$ after 24 hours.

EXAMPLE 4

30 g of copolymers of isobutylene-maleic anhydride, 20 g of caustic soda and 150 g of water were mixed together, and made into solution by heating at 65° C. 40 g of the resulting solution was admixed with 1 kg of silica sands JIS No. 100, 10 g of an aqueous solution of partially saponified polyvinyl alcohol at a concentration of 20% by weight, 20 g of slaked lime and 5 g of sodium salt of gluconic acid, and test pieces, 50 mm in diameter×50 mm long, were prepared therefrom, and tested in the same manner as in Example 1. As a result, it was found that the compression strength was 8.0 kg/cm$^2$ right after the molding (right after the injection of a $CO_2$ gas) and 43 kg/cm$^2$ after 24 hours.

EXAMPLE 5

Hardening characteristics of molds prepared from the present binder composition of Example 1 and a binder composition comprising 20% polyvinyl alcohol and calcium hydroxide were investigated. Mixing proportions of mold sands and test results are shown in Table 2. Test pieces were cylindrical columns, 25 mm in diameter×300 mm, and mold sands were filled in a metal mold, and treated with a $CO_2$ gas under a pressure of 1 kg/cm$^2$ for 10 seconds from one end thereof. Length of hardened layer was measured.

TABLE 2

| Mold sands | Item: Mixing proportion | | Length of hardened layer |
|---|---|---|---|
| The present invention | Silica sands JIS No. 65: | 1 kg | 300 mm (entirely uniformly hardened) |
| | Binder composition of Ex. 1: | 40 g | |
| Binder comprising polyvinyl alcohol and calcium hydroxide | Silica sand JIS No. 65: | 1 kg | 185 mm (approximately half-hardened) |
| | Aqueous 20% polyvinyl alcohol solution: | 40 g | |
| | Calcium hydroxide: | 20 g | |

The present binder material has a good reactivity with the $CO_2$ gas, a high hardening speed, and a good production efficiency of mold, and further the mold can be hardened with a small amount of $CO_2$ gas, rendering the production economical.

EXAMPLE 6

A mold was prepared from the binder material of Example 1 in the same mixing proportion as in Example 1, and a motor housing having a product weight of 18 kg was cast in the resulting mold. As a result, it was found that there was no casting defect and a good collapsing property especially at a core part. It was recognized that the present invention could be effectively utilized as a mold binder material for casting.

EXAMPLE 7

A binder composition was prepared in the same manner as in Example 1, except that 10 g of ethylene glycol was used in place of sodium salt of gluconic acid, and test pieces were prepared therefrom in the same manner as in Example 1, and tested. Test results are shown in Table 3.

TABLE 3

| Time (hr.) | Compression strength (kg/cm$^2$): Right after molding | 1 | 2 | 3 | 4 | 24 |
|---|---|---|---|---|---|---|
| Test piece (present invention) | 7.4 | 11 | 13 | 15 | 18 | 37 |

As is evident from Table 3, the strength right after the molding, an increase in the strength with time and the strength after 24 hours were high, and also the working atmosphere was good.

EXAMPLE 8

A binder composition was prepared in the same manner as in Example 2, except that 15 g of glycerine was used in place of sodium salt of gluconic acid, and test pieces were prepared therefrom in the same manner as in Example 1, and tested. As a result, it was found that a compression strength was 9.0 kg/cm$^2$ right after the molding, and 30 kg/cm$^2$ after 24 hours.

EXAMPLE 9

A binder composition was prepared in the same manner as in Example 3, except that 20 g of diethylene glycol was used in place of sodium salt of gluconic acid, and test pieces were prepared therefrom in the same manner as in Example 1, and tested. As a result, it was found that a compression strength was 9.6 kg/cm$^2$ right after the molding and 36 kg/cm$^2$ after 24 hours.

EXAMPLE 10

A binder composition was prepared in the same manner as in Example 4, except that 5 g of sorbitol was used in place of sodium salt of gluconic acid, and test pieces were prepared therefrom in the same manner as in Example 1, and tested. As a result, it was found that a compression strength was 8.0 kg/cm$^2$ right after the molding, and 43 kg/cm$^2$ after 24 hours.

EXAMPLE 11

A mold was prepared from the binder composition of Example 7, and its hardening characteristics were investigated. Mixing proportion and test results are given in Table 4.

The binder composition had a good reactivity with a $CO_2$ gas, a high hardening speed, and a good production efficiency of mold. Furthermore, the mold was hardened with a small amount of $CO_2$ gas, making the production economical.

TABLE 4

| Mold sand | Item: Mixing proportion | | Length of hardened layer |
|---|---|---|---|
| The present invention | Silica sands JIS No. 65: | 1 kg | 300 mm (entirely uniformly hardened) |
| | Binder of Ex. 7: | 40 g | |

EXAMPLE 12

A mold was prepared from the binder composition of Example 7 in the same mixing proportion as in Example 7, and a motor housing having a product weight of 18 kg was cast in the resulting mold. As a result, it was found that there was no casting defect, and a good collapsing property especially at the core part. It was recognized that the present invention can be effectively utilized as a mold binder material for casting.

EXAMPLE 13

120 g of copolymers of isobutylene-maleic anhydride (molar ratio 1:1), 50 g of caustic soda and 180 g of water were mixed together, and made into solution by heating at 90° C. The resulting solution was admixed with 300 g of slaked lime, and successively with 500 g of water, and stirred to prepare a white suspension solution. The resulting suspension solution was admixed with 360 g of a latex (solid content: 50% by weight) of copolymers of styrene-butadiene and 10 g of sodium salt of gluconic acid to make a binder composition. 40 g of the binder composition was admixed with 1 kg of silica sands JIS No. 100, and test pieces, 50 mm in diameter×50 mm long, were prepared from the resulting mixture by ramming and aerated with a $CO_2$ gas under a pressure of 1 kg/cm$^2$ for 5 seconds. Increase in strength with time from the preparation of test pieces was investigated, and the results are given in Table 5.

TABLE 5

| | Compression strength (kg/cm$^2$) | | | | | |
|---|---|---|---|---|---|---|
| Time (hr.) | Right after molding | 1 | 2 | 3 | 5 | 24 |
| Test piece (the present invention) | 7.5 | 12 | 14 | 18 | 23 | 40 |

As is evident from Table 5, the strength right after the molding, the increase in strength with time and the strength after 24 hours were high, and also the working atmosphere was good.

EXAMPLE 14

120 g of copolymers of styrene-maleic anhydride, 50 g of caustic soda, and 180 g of water were mixed together, and made into solution by heating. The resulting solution was admixed successively with 300 g of slaked lime, 500 g of water and 5 g of sodium salt of gluconic acid and stirred to prepare a white suspension solution (binder 1).

120 g of copolymers of methylvinyl ether-maleic anhydride, 50 g of caustic soda, and 180 g of water were mixed together, and made into solution by heating. The resulting solution was admixed successively with 300 g of slaked lime, 500 g of water, and 5 g of sodium salt of gluconic acid, and stirred to prepare a white suspension solution (binder 2).

Strength tests of molds prepared individually from binders 1 and 2 were conducted in the same mixing proportion and $CO_2$ gas treatment as in Example 13. Results are shown in Table 6.

TABLE 6

| | Compression strength (kg/cm$^2$) | |
|---|---|---|
| Time (hr.) | Right after molding | 24 |
| Binder 1 | 6.1 | 25 |
| Binder 2 | 6.3 | 30 |

EXAMPLE 15

25 g of copolymers of isobutylene-maleic anhydride, 13 g of caustic soda, and 62 g of water were mixed together, and made into solution by heating at 65° C. The resulting solution was admixed successively with 60 g of slaked lime, 1.25 g of zinc hydroxide, 20 g of SBR latex, 50 g of water and 5 g of sodium salt of gluconic acid, and stirred to prepare a white suspension solution as a binder, and a strength test of mold prepared therefrom in the same mixing proportion as in Example 13 was conducted. As a result, it was found that a compression strength was 7.4 kg/cm$^2$ right after molding and 34 kg/cm$^2$ after 24 hours.

EXAMPLE 16

The solution prepared from the copolymers of isobutylene-maleic anhydride, caustic soda and water in Example 15 was admixed with the corresponding amounts of the other additives of Example 15 not right after the preparation of said solution, but at the preparation of mold sands, and further admixed separately with 10 g of slaked lime and 3 g of sodium salt of gluconic acid, and the same tests as in Example 13 were conducted for test pieces prepared therefrom. As a result, it was found that a compression strength was 6.2 kg/cm$^2$ right after molding, and 34 kg/cm$^2$ after 24 hours.

EXAMPLE 17

A mold was prepared from the binder composition of Example 13, and its hardening characteristics were investigated. Mixing proportion and test result are given in Table 7. The binder composition had a good reactivity with a $CO_2$ gas, a high hardening speed, and a good production efficiency of mold. Furthermore, the mold was hardened with a small amount of $CO_2$ gas, making the production economical.

TABLE 7

| | Item | | |
|---|---|---|---|
| Mold sand | Mixing proportion | | Length of hardened layer |
| The present invention | Silica sands JIS No. 65: | 1 kg | 300 mm (entirely uniformly hardened) |
| | Binder of Ex. 13: | 40 g | |

EXAMPLE 18

A mold was prepared from the binder composition of Example 13 in the same mixing proportion as in Example 13, and a motor housing having a product weight of 18 kg was cast. As a result, it was found that there was no casting defect, but a good collapsing property especially at the core part. It was recognized that the present invention can be effectively utilized as a mold binder material for casting.

EXAMPLE 19

A binder composition was prepared in the same manner as in Example 13, except that 10 g of glycerin was used in place of sodium salt of gluconic acid, and test pieces were prepared in the same manner as in Example 13, and tested. Results are given in Table 8.

TABLE 8

| | Compression strength (kg/cm$^2$) | | | | | |
|---|---|---|---|---|---|---|
| Time (hr.) | Right after molding | 1 | 2 | 3 | 5 | 24 |
| Test piece (the present invention) | 7.8 | 13 | 16 | 18 | 23 | 40 |

As is evident from Table 8, the strength right after the molding, the increase in strength with time, and the strength after 24 hours were high, and also the working atmosphere was good.

EXAMPLE 20

120 g of copolymers of styrene-maleic anhydride, 50 g of caustic soda, and 180 g of water were mixed and made into solution by heating. The resulting solution was admixed successively with 300 g of slaked lime, 500 g of water, and 5 g of sorbitol, and stirred to prepare a white suspension solution (binder 1).

120 g of copolymers of methylvinyl ether-maleic anhydride, 50 g of caustic soda, and 180 g of water were mixed together, and made into solution by heating. The resulting solution was admixed successively with 300 g of slaked lime, 500 g of water, and 5 g of diethylene glycol, and stirred to prepare a white suspension solution (binder 2).

Strength tests of molds prepared from binders 1 and 2 were conducted in the same mixing proportion and $CO_2$ gas treatment as in Example 13. Results are given in Table 9.

TABLE 9

| | Compression strength ($kg/cm^2$) | |
|---|---|---|
| Time (hr.) | Right after molding | 24 |
| Binder 1 | 6.1 | 25 |
| Binder 2 | 6.3 | 30 |

EXAMPLE 21

A binder composition was prepared in the same manner as in Example 15 except that 5 g of ethylene glycol was used in place of sodium salt of gluconic acid, and test pieces were prepared therefrom in the same manner as in Example 13, and tested. As a result, it was found that a compression strength was 7.4 $kg/cm^2$ right after the molding and 34 $kg/cm^2$ after 24 hours.

EXAMPLE 22

The solution prepared from the copolymers of isobutylene-maleic anhydride, caustic soda and water in Example 21 was admixed with the corresponding amounts of the other additives of Example 15 not right after the preparation of said solution, but at the preparation of mold sands, and further admixed separately with 10 g of slaked lime and 3 g of 3-methylpentane-1,3,5-triol, and test pieces were prepared in the same manner as in Example 13, and tested. As a result, it was found that a compression strength was 7.8 $kg/cm^2$ right after molding and 39 $kg/cm^2$ after 24 hours.

EXAMPLE 23

A mold was prepared from the binder composition of Example 19 and its hardening characteristics were investigated. Mixing proportion and test results are given in Table 10.

TABLE 10

| | Item | | |
|---|---|---|---|
| Mold sand | Mixing proportion | | Length of hardened layer |
| The present invention | Silica sand JIS No. 65: | 1 kg | 300 mm (entirely uniformly hardened) |
| | Binder of Example 19: | 40 g | |

EXAMPLE 24

A mold was prepared from the binder of Example 19 in the same mixing proportion as in Example 19, and a motor housing having a product weight of 18 kg was cast in the resulting mold. As a result, it was found that there was no casting defect, but a good collapsing property especially at the core part. It was recognized that the present invention can be effectively utilized as a mold binder material for casting.

What is claimed is:

1. A mold binder material for a mold to be hardened with a $CO_2$ gas, which comprises a combination of an aqueous solution of at least one caustic alkali-neutralized copolymer selected from the group consisting of α-olefin-maleic anhydride copolymer, styrene-maleic anhydride copolymer, and methylvinyl ether-maleic anhydride copolymer; not more than 800%, on the basis of the caustic-alkali neutralized copolymer, of at least one multi-valent metal oxide or hydroxide; and 3 to not more than 100% by weight of the sodium salt of gluconic acid or of polyhydric alcohol on the basis of the aqueous solution of caustic-alkali neutralized copolymer.

2. A mold binder material for a mold to be hardened with a $CO_2$ gas, which comprises a combination of an aqueous solution of at least one caustic alkali-neutralized copolymer selected from the group consisting of α-olefin-maleic anhydride copolymer, styrene-maleic anhydride copolymer, and methylvinyl ether-maleic anhydride copolymer, not more than 800%, on the basis of the caustic alkali-neutrualized copolymer of calcium hydroxide, and 3 to not more than 100% by weight of the sodium salt of gluconic acid on the basis of the aqueous solution of caustic alkali-neutralized copolymer.

3. A mold binder material according to claim 2, wherein 3 to 50% by weight of a sodium salt of gluconic acid is contained on the basis of the aqueous solution of caustic alkali-neutralized copolymer.

4. A mold binder material according to claim 2, wherein not more than 300% by weight of the caustic hydroxide is contained on the basis of the caustic alkali-neutralized copolymer.

5. A mold binder material according to claim 2, wherein the α-olefin is any of ethylene, propylene, n-butene, isobutylene, n-pentene, isoprene, and 2-methyl-1-butene.

6. A mold binder material for a mold to be hardened with a $CO_2$ gas, which comprises a combination of an aqueous solution of at least one caustic alkali-neutralized copolymer selected from the group consisting of α-olefin-maleic anhydride copolymer, styrene-maleic anhydride copolymer, and methylvinyl ether-maleic anhydride copolymer, not more than 800%, on the basis of the caustic alkali-neutralized copolymer, of calcium hydroxide, and 3 to not more than 100% by weight of polyhydric alcohol on the basis of the aqueous solution of caustic alkali-neutralized copolymer.

7. A mold binder material according to claim 6, wherein the polyhydric alcohol is ethylene glycol, glycerine, propylene glycol, sorbitol, or mannite.

8. A mold binder material according to claim 6, wherein 3 to 40% by weight of the polyhydric alcohol is contained on the basis of the aqueous solution of caustic alkali-neutralized copolymer.

9. A mold binder material according to claim 6, wherein not more than 300% by weight of the caustic hydroxide is contained on the basis of the caustic alkali-neutralized copolymer.

* * * * *